US010751678B2

(12) United States Patent
Farrar et al.

(10) Patent No.: US 10,751,678 B2
(45) Date of Patent: Aug. 25, 2020

(54) CONTINUOUS ACOUSTIC MIXER PLATE CONFIGURATIONS

(71) Applicant: Resodyn Corporation, Butte, MT (US)

(72) Inventors: Lawrence C. Farrar, Butte, MT (US); Grayson Sperry, Three Forks, MT (US); Peter A. Lucon, Butte, MT (US); Robb L. LaTray, Butte, MT (US); Christopher Michael Miller, Anaconda, MT (US)

(73) Assignee: Rosodyn Corporation, Butte, MT (US)

( * ) Notice: Subject to any disclaimer, the term of this patent is extended or adjusted under 35 U.S.C. 154(b) by 184 days.

(21) Appl. No.: 15/686,709

(22) Filed: Aug. 25, 2017

(65) Prior Publication Data

US 2019/0060853 A1 Feb. 28, 2019

(51) Int. Cl.

| | |
|---|---|
| ***B01F 11/02*** | (2006.01) |
| ***B01F 11/00*** | (2006.01) |
| ***B01F 5/06*** | (2006.01) |
| ***B01F 3/12*** | (2006.01) |

(52) U.S. Cl.

CPC ..... *B01F 11/02* (2013.01); *B01F 3/1242* (2013.01); *B01F 5/0606* (2013.01); *B01F 11/0077* (2013.01); *B01F 11/0241* (2013.01)

(58) Field of Classification Search

CPC ... B01F 11/02; B01F 11/0077; B01F 11/0241; B01F 3/1242; B01F 15/0606

USPC ..... 366/108

See application file for complete search history.

(56) References Cited

U.S. PATENT DOCUMENTS

2003/0044332 A1 3/2003 Conrad et al.
2013/0329514 A1* 12/2013 Farrar ..... B01F 11/0266 366/111
2016/0031770 A1 2/2016 Guo et al.

FOREIGN PATENT DOCUMENTS

DE 304129 * 3/1918 ..... B01D 3/24
DE 304129 C 3/1918
WO 2014031390 A2 2/2014

OTHER PUBLICATIONS

International Search Report and Written Opinion dated Jun. 19, 2019 in PCT Application No. PCT/US2018/047785.

* cited by examiner

*Primary Examiner* — Marc C Howell
(74) *Attorney, Agent, or Firm* — McDermott Will & Emery LLP

(57) ABSTRACT

A system for continuously processing materials. The system includes a continuous process vessel (CPV) and an acoustic agitator coupled to the CPV and configured to agitate the CPV along an oscillation axis. The CPV includes at least one inlet configured for introducing first and second process ingredients into an upper portion, with respect to the oscillation axis, of the CPV. The CPV includes an outlet for discharging the product of mixing the ingredients from a lower portion, with respect to the oscillation axis, of the CPV. The CPV includes a plurality of mixing regions, each defined by an upper angled surface and a lower angled surface. The surfaces of each mixing region are angled such that the distance between the surfaces is greater towards the upper portion of the continuous process vessel than the distance between the surfaces towards the lower portion of the continuous process vessel.

23 Claims, 8 Drawing Sheets

CONTINUOUS ACOUSTIC MIXER PLATE CONFIGURATIONS

GOVERNMENT LICENSE RIGHTS

This invention was made with government support under FA9400-11-C-3011 awarded by the United States Air Force (USAF) and WP-2605 awarded by the Strategic Environmental Research and Development Program (SERDP). The government has certain rights in the invention.

BACKGROUND

A continuous acoustic mixer (CAM) is a device that can impart acoustic energy onto one or more materials passing through it. The acoustic energy can mix, react, coat, or combine the materials. The CAM can often process materials more quickly and uniformly than batch mixers. In some applications, the CAM can process a solid material and a liquid material together to form a paste.

SUMMARY

At least one aspect is directed to system for continuously processing a combination of materials. The system includes a continuous process vessel configured to oscillate along an oscillation axis. The continuous process vessel includes a plurality of side walls extending along the oscillation axis. The continuous process vessel includes at least one inlet configured for introducing at least a first process ingredient and a second process ingredient into an upper portion, with respect to the oscillation axis, of the continuous process vessel. The continuous process vessel includes an outlet positioned towards a lower portion, with respect to the oscillation axis, of the continuous process vessel, for discharging a product of mixing the first and second process ingredients as they traverse through the continuous process vessel. The continuous process vessel includes a plurality of angled surfaces, each angled surface coupled at one end to one of the side walls of the continuous process vessel. The plurality of angled surfaces include i) upper angled surfaces oriented to face the outlet and angled with respect to a horizontal axis, which is normal to the oscillation axis, and ii) lower angled surfaces oriented to face the at least one inlet and angled with respect to the horizontal axis. The plurality of angled surfaces form a plurality of mixing regions, each mixing region defined by an upper angled surface and an opposing lower angled surface, wherein the upper angled surface and the lower angled surface of each mixing region are angled with respect to the horizontal axis such that the distance between the upper angled surface and the lower angled surface is greater towards the upper portion of the continuous process vessel than the distance between the upper angled surface and the lower angled surface towards the lower portion of the continuous process vessel. The system includes an acoustic agitator coupled to the continuous process vessel and configured to agitate the continuous process vessel along the oscillation axis.

In some implementations, each lower angled surface has an angle with respect to the horizontal axis that is greater than 1° and less than 20°, and each upper angled surface has an angle with respect to the horizontal axis that is greater than 2° and less than 35°. In some implementations, each lower angled surface has an angle with respect to the horizontal axis that is greater than 1° and less than 5°, and each upper angled surface has an angle with respect to the horizontal axis that is greater than 5° and less than 20°.

In some implementations, the distance between the lower angled surface and the upper angled surface of each mixing layer is between 0.25 inches and 3 inches at their closest point.

In some implementations, the plurality of mixing layers is divided into a first mixing stage and a second mixing stage, the upper angled surface and the lower angled surface of each mixing layer in the first mixing stage are separated by a first distance at their closest point, and the upper angled surface and the lower angled surface of each mixing layer in the second mixing stage are separated by a second distance less than the first distance at their closest point.

In some implementations, the plurality of mixing layers is divided into a first mixing stage, a second mixing stage, and a third mixing stage, the upper angled surface and the lower angled surface of each mixing layer in the first mixing stage are separated by a first distance at their closest point, the upper angled surface and the lower angled surface of each mixing layer in the second mixing stage are separated by a second distance less than the first distance at their closest point, and the upper angled surface and the lower angled surface of each mixing layer in the third mixing stage are separated by a third distance less than the second distance at their closest point.

In some implementations, the acoustic agitator is configured to agitate the continuous process vessel with a displacement along the oscillation axis that is greater than 0.125 inches and less than 1.5 inches.

In some implementations, the system is configured to operate at mechanical resonance.

In some implementations, the acoustic agitator is configured to agitate the continuous process vessel with an acceleration greater than 1G and less than 200 Gs.

In some implementations, the acoustic agitator is configured to agitate the continuous process vessel at a frequency greater than 1 Hz and less than 1 KHz. In some implementations, the acoustic agitator is configured to agitate the continuous process vessel at a frequency greater than 10 Hz and less than 100 Hz.

At least one aspect is directed to a method for continuously processing a combination of materials. The method includes introducing, via at least one inlet, at least a first process ingredient and a second process ingredient into an upper portion, with respect to the oscillation axis, of the continuous process vessel. The continuous process vessel includes a plurality of angled surfaces, each angled surface coupled at one end to one of the side walls of the continuous process vessel. The plurality of angled surfaces include i) upper angled surfaces oriented to face the outlet and angled with respect to a horizontal axis, which is normal to the oscillation axis, and ii) lower angled surfaces oriented to face the at least one inlet and angled with respect to the horizontal axis. The plurality of angled surfaces form a plurality of mixing regions, each mixing region defined by an upper angled surface and an opposing lower angled surface, wherein the upper angled surface and the lower angled surface of each mixing region are angled with respect to the horizontal axis such that the distance between the upper angled surface and the lower angled surface is greater towards the upper portion of the continuous process vessel than the distance between the upper angled surface and the lower angled surface towards the lower portion of the continuous process vessel. The method includes agitating the continuous process vessel with an acoustic agitator coupled to the continuous process vessel and configured to agitate the continuous process vessel along the oscillation axis. The method includes discharging, from an outlet positioned towards a lower portion, with respect to the oscillation axis, of the continuous process vessel, a product of the first process ingredient and the second process ingredient subsequent to the first process ingredient and the second process ingredient passing through at least a portion of the continuous process vessel while being exposed to the acoustic energy transferred by at least one upper angled surface and one lower angled surface.

In some implementations, the acoustic agitator is configured to agitate the continuous process vessel with a displacement along the oscillation axis that is greater than 0.125 inches and less than 1.5 inches.

In some implementations, the acoustic agitator and the continuous process vessel operate at mechanical resonance.

In some implementations, the acoustic agitator agitates the continuous process vessel with an acceleration greater than 1G and less than 200 Gs.

In some implementations, the acoustic agitator agitates the continuous process vessel at a frequency greater than 1 Hz and less than 1 KHz. In some implementations, the acoustic agitator agitates the continuous process vessel at a frequency greater than 10 Hz and less than 100 Hz.

In some implementations, each lower angled surface has an angle with respect to the horizontal axis that is greater than 1° and less than 20°, and each upper angled surface has an angle with respect to the horizontal axis that is greater than 2° and less than 35°.

In some implementations, the first process ingredient is a liquid and the second process ingredient is a solid.

In some implementations, the first process ingredient is a liquid and the second process ingredient is a viscous liquid.

In some implementations, the product is a paste or viscous liquid.

In some implementations, at least one process ingredient is a liquid process ingredient, and the method can include adding gas to the liquid process ingredient prior to introducing the liquid process ingredient into the upper portion of the continuous process vessel.

In some implementations, the method includes introducing, via the at least one inlet, a third process ingredient. The third process ingredient is a gas.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification.

BRIEF DESCRIPTION OF THE DRAWINGS

The accompanying drawings are not intended to be drawn to scale. Like reference numbers and designations in the various drawings indicate like elements. For purposes of clarity, not every component may be labeled in every drawing. In the drawings.

DETAILED DESCRIPTION

Figure 1:
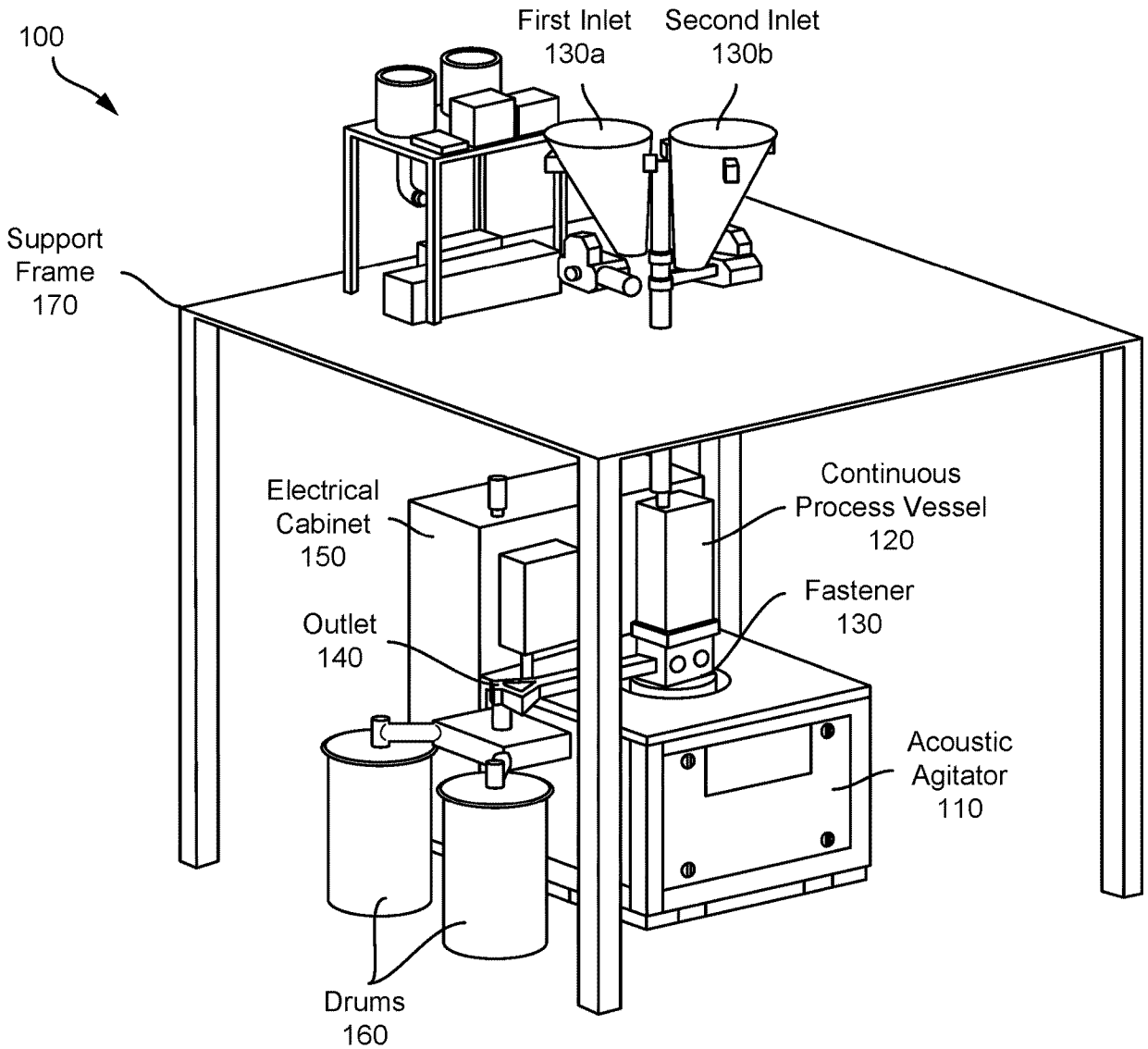
FIG. 1 is a diagram of a continuous acoustic mixer for continuously processing a combination of materials, according to an illustrative implementation.

This disclosure generally relates to a continuous acoustic mixer (CAM). A CAM operates using an acoustic agitator to oscillate a continuous process vessel. The continuous process vessel can include internal structural features configured to transfer the oscillations into process ingredients passing through. The structural features can include plates, wedges, or baffles having angled surfaces that act to impart acceleration forces on the process ingredients. These forces cause mixing and reacting of the process ingredients. In some implementations, the frequency of the oscillations can be relatively low while the acceleration forces can be relatively high. For example, in some implementations, the frequency of the oscillations can be greater than 1 Hz and less than 1 KHz. The acceleration forces can be greater than 1G up to hundreds of Gs. The relatively low-frequency, high-intensity acoustic energy is used to create a near uniform shear field throughout substantially the entire continuous process vessel, which results in rapid fluidization, reaction, and/or dispersion of the process ingredients. This process can be referred to as low-frequency acoustic agitation or "LFAA." Operation at such high accelerations can cause subject the components of the CAM to large mechanical stresses. In some implementations, however, the CAM can operate at or near resonance, which promotes efficient operation.

In some applications, the CAM can be used to combine dry and liquid process ingredients to generate a paste or viscous liquid product. Processing paste products having certain physical properties can pose challenges. In particular, pastes having a certain minimum viscosity and surface tension may not exhibit the desired bulk flow through the continuous process vessel. For example, a continuous process vessel may have a plurality of internal plates angled downward for imparting acceleration forces on the paste. Under certain conditions, however, the downward angle of the plates may actually cause the paste to travel upstream. In such cases, the back flow of the paste may form a plug at an opening at a lower end of a plate above. Process ingredients may back up behind this plug until they dislodge the plug and discharge it from the continuous process vessel. Once the plug exits the continuous process vessel, the sequence repeats in an effect referred to as "chugging."

The phenomenon of back flow occurs as follows. The paste or viscous liquid can adhere to an upward-facing surface of a plate or wedge of the continuous process vessel. As the plate accelerates upwards, a top surface of the paste extends laterally in the direction of the downward angle of the plate; i.e., if the plate is angled downward to the right, the top surface of the paste will extend to the right. A bottom surface of the paste or viscous liquid will not extend as far in the same direction as the top surface of the paste or viscous liquid however, due to the bottom layer's adherence to the surface of the plate. Thus, the paste forms a "toe" extending laterally away from the plate. When the plate then accelerates downwards, the acceleration lifts the toe away from the plate. As the plate continues its oscillatory movement, the surface tension and viscosity of the paste or viscous liquid cause the toe to continue rotating upwards and away from its original lateral extension until it folds over in the upstream direction. As this process repeats, the paste or viscous liquid can flow backwards/upstream to the upper end of the plate, and may block the opening at the lower end of the plate above. This phenomenon can occur with materials having a viscosity greater than approximately 100 cps and a surface tension greater than approximately 5 dyne/cm.

Altering the arrangement and/or shape of the structures within the continuous process vessel can prevent this back flow of pastes or viscous liquids. For example, with the plate defining a lower angled surface, an upper angled surface can be added to define a mixing region between the two. Each mixing region can form a mixing layer of the continuous process vessel. The upper angled surface can be positioned to interfere with the upstream rotation of the toe of paste, or viscous liquid, and prevent back flow. The relative angles of the upper angled surface and the lower angled surface can affect the behavior of the paste or viscous liquid. In the following examples, the continuous process vessel is configured to oscillate along an oscillation axis, and the angles of the upper and lower angled surfaces are described with reference to a horizontal axis normal to the oscillation axis.

If an upper angled surface angle with respect to the horizontal axis is greater than a lower angled surface angle with respect to the horizontal axis, the mixing region narrows in the desired direction of flow. With a greater angle relative to the horizontal axis, the upper angled surface will impose a forward force on the paste that is greater than the backwards force imposed by the lower angled surface. The upper and lower angled surfaces therefore interact with the paste to bring about a downward bulk flow. In some implementations, the process ingredients may not intrinsically have viscosity, density, and/or surface tension characteristics to exhibit this roll-back and push-forward phenomena. Therefore, in some implementations, the system can introduce bubbles of gas, such as air, nitrogen, oxygen, argon, hydrogen, helium, carbon dioxide, neon, fluorine, chlorine, xenon, or other vapors, or combinations thereof, into one or more liquid process ingredients prior to introduction into the continuous process vessel. The addition of gas bubbles into the liquid can be set to bring about the desired bulk flow.

If the upper angled surface angle and thee lower angled surface are both the same relative to the horizontal axis—i.e., the upper and lower angled surfaces are parallel—the pushing forces of each planar surface cancel out, resulting in a low bulk flow of the paste driven primarily by gravity. In some implementations, the angled surfaces can be spaced relatively widely to limit interaction between the paste and the upper angled surface. Angled surfaces in this configuration can allow a certain amount of roll-back. The buildup of material upstream of the roll-back area can push the material down the slope. This mechanism can improve incomplete or poor mixing caused by factors such as variation in feed rate among process ingredients, upstream/downstream segregation of the process ingredients due to different densities, one process ingredient riding atop another with respect to the lower angled surfaces, or differing propensities for flow among the process ingredients.

If the upper angled surface angle with respect to the horizontal axis is lower than the lower angled surface angle with respect to the horizontal axis, the mixing region widens in the desired direction of bulk flow. The effect, however, is that the back flow of paste or viscous liquid caused by the lower angled surface is greater than the forward flow caused by the upper angled surface. In some implementations, however, the reduced downstream flow can be used to enhance mixing of process ingredients that tend to separate under certain mixing conditions such as those described in the previous paragraph.

These and other functions are described further below with reference to FIGS. 1-4.

FIG. 1 is a diagram of a continuous acoustic mixer (CAM) 100 for continuously processing a combination of materials, according to an illustrative implementation. The CAM 100 can be, for example, similar to the continuous processing system disclosed in U.S. Patentent Publication Number US 2013/0329514 A1 assigned to Resodyn Corporation of Butte, Mont., USA, the entirety of which is incorporated herein by reference. The CAM 100 includes a continuous process vessel 120 coupled to an acoustic agitator 110. The continuous process vessel 120 can be coupled to the acoustic agitator 110 with a fastener 130. The acoustic agitator 110 receives power from an electrical cabinet 150. The continuous process vessel 120 can include a first inlet 130*a* configured for receiving at least a first process ingredient and a second inlet 130*b* configured for receiving at least a second process ingredient. The continuous process vessel 120 includes an outlet 140 for discharging a product of the process ingredients subsequent to the process ingredients passing through a portion of the continuous process vessel 120 while being exposed to the acoustic energy. The outlet 140 can discharge the product into one or more drums 160. A support frame 170 can hold various components of the CAM 100.

In some implementations, the acoustic agitator 110 can be a RAM Mixer, such as those available from Resodyn Corporation. In some implementations, the acoustic agitator 110 can agitate the continuous process vessel 120 with a displacement greater than 0.125 inches and less than 1.5 inches. In some implementations, the acoustic agitator 110 can agitate the continuous process vessel 120 with an acceleration greater than 1G and less than 200 Gs. In some implementations, the acoustic agitator 110 can agitate the continuous process vessel 120 at a frequency greater than 1 Hz and less than 1 KHz. In some implementations, the acoustic agitator 110 can agitate the continuous process vessel 120 at a frequency greater than 10 Hz and less than 100 Hz. In some implementations, the acoustic agitator 110 can agitate the continuous process vessel 120 at a frequency of approximately 60 Hz.

The continuous process vessel 120 includes a plurality of interior structures—e.g., plates, baffles, or wedges, etc.—having angled surfaces configured to transfer acoustic energy generated by the acoustic agitator 110 into the process ingredients, and to direct a flow of the process ingredients through the continuous process vessel 120. The different implementations of the continuous process vessel 120 can support a variety of processes, for example mixing, combining, drying, coating, segregating, and reacting of process ingredients. In some implementations, the continuous process vessel 120 can combine a liquid process ingredient and a solid process ingredient and produce a paste or viscous liquid product. In some implementations, the continuous process vessel 120 can combine a liquid process ingredient and a viscous liquid process ingredient to produce a paste or viscous liquid product. The interior structures of the continuous process vessel 120 can be arranged to promote continuous bulk flow of the process ingredients through the continuous process vessel 120. The interior structures of the continuous process vessel 120 can take a variety of configurations, as will be discussed in greater detail below with reference to FIGS. 2 and 3.

Figure 2:
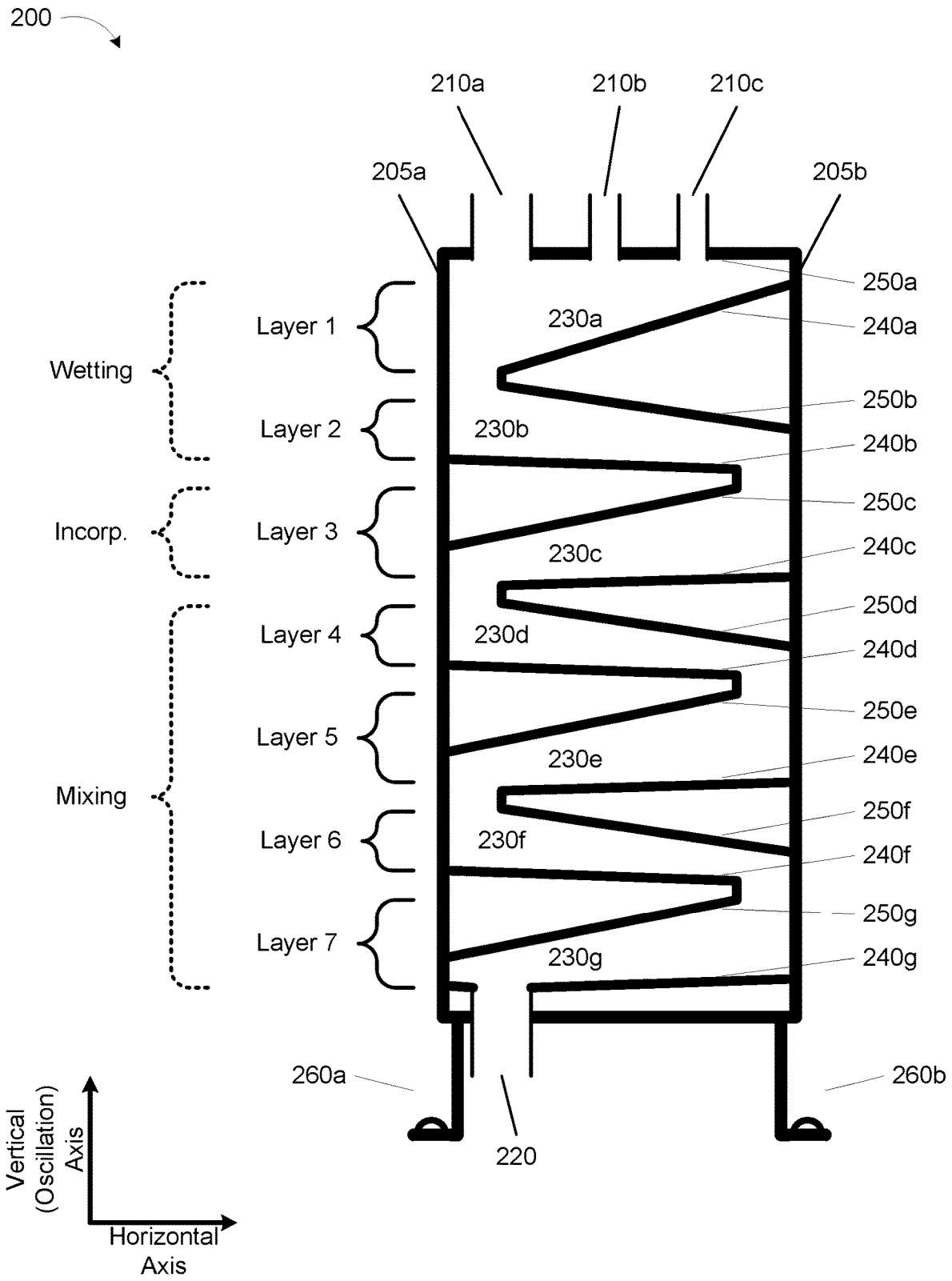
FIG. 2 shows a cross section of a continuous process vessel, according to an illustrative implementation.

FIG. 2 shows a cross section of a continuous process vessel 200, according to an illustrative implementation. The continuous process vessel 200 is appropriate for serving as the continuous process vessel 120 described previously with respect to FIG. 1. The continuous process vessel 200 can include structural features that make it particularly well suited for combining respective liquid and solid process ingredients and processing them into a paste.

The continuous process vessel 200 includes side walls 205*a* and 205*b* (collectively "side walls 205") enclosing an interior of the continuous process vessel 200. The side walls 205 can extend approximately along an oscillation axis. The oscillation axis can be oriented approximately vertically. In some implementations, the side walls 205 can be straight, curved, or articulated. In some implementations, the side walls 205 can be substantially parallel to each other. In some implementations, the side walls 205 may be angled with respect to each other such that they widen or narrow in a direction along the oscillation axis.

The continuous process vessel 200 includes one or more inlets including a first inlet 210*a*, a second inlet 210*b*, and a third inlet 210*c* (collectively "inlets 210"). The inlets 210 can be positioned near an upper portion, with respect to the oscillation axis, of the continuous process vessel 200. Each inlet can be configured to receive a different process ingredient. In some implementations, the continuous process vessel 200 may include a single inlet 210 configured to receive one or more process ingredients. In some implementations, one or more of the process ingredients can be a liquid process ingredient. In some situations, the liquid process ingredient may have physical properties that adversely affect its behavior in the continuous process vessel 200. For example, it may have a combination of viscosity, density, and or surface tension that prevent it from exhibiting the desired roll-back, push-forward activity. Accordingly, in some implementations, the liquid process ingredient can be injected with gas, such as oxygen, argon, hydrogen, helium, carbon dioxide, neon, fluorine, chlorine, xenon, or other vapors, or combinations thereof. The gas can increase or decrease the physical properties of the liquid process ingredient as desired. In some implementations, one or more of the inlets 210 can include structures for injecting or premixing the liquid process ingredient with gas prior to introduction into the continuous process vessel 200.

The inlets 210 can introduce process ingredients into the upper portion of the continuous process vessel 200. The continuous process vessel 200 includes an outlet 220 for discharging a product of the process ingredients. The outlet 220 can be positioned towards a lower portion of the continuous process vessel 200. The continuous process vessel 200 includes mounts 260*a* and 260*b* (collectively "mounts 260"). The mounts 260 can include a flange, pillar, pedestal, frame, bracket, or other structural component suitable for fastening to an acoustic agitator such as the acoustic agitator 110. The mounts 260 can be clamped, bolted, riveted, pinned, and/or latched to the acoustic agitator. In some implementations, the mounts 260 can be removably fastened to the acoustic agitator. The mounts 260 can by sturdy, physically robust supports capable of transferring large forces from the acoustic agitator to the continuous process vessel 200.

The continuous process vessel 200 includes a plurality of mixing layers: Layer 1 through Layer 7. In some implementations, the continuous process vessel 200 can include more or fewer layers. Each layer defines a mixing region 230*a*-230*g* (collectively "mixing regions 230") having an upper angled surface 250*a*-250*g* (collectively "upper angled surfaces 250") and a lower angled surface 240*a*-240*g* (collectively "lower angled surfaces 240"). Each upper angled surface 250 and lower angled surface 240 is coupled at one end to (or extends out from) one of the side walls 205 of the continuous process vessel 200. The upper angled surfaces 250 and the lower angled surfaces 240 are configured to transfer acoustic energy from the acoustic agitator to the process ingredients. The upper angled surfaces 250 are generally oriented to face the outlet 220 and are angled with respect to a horizontal axis, which is normal to the oscillation axis. The lower angled surfaces 240 are generally oriented to face the inlet 210 and are angled with respect to the horizontal axis. The upper angled surfaces 250 and the lower angled surfaces 240 form the mixing regions 230. The upper angled surface 250 and lower angled surface 240 of each mixing region 230 are angled with respect to the horizontal axis such that the distance between the upper angled surface 250 and the lower angled surface 240 is greater towards the upper portion of the continuous process vessel 200 than the distance between the upper angled surface 250 and the lower angled surface 240 towards the lower portion of the continuous process vessel 200. This narrowing of the mixing regions 230 promotes continuous bulk flow of the materials from inlet to output.

In some implementations, the mixing layers can fall into two or more stages. The stages can loosely correspond to the physical properties of the process ingredients in that layer. For example, the continuous process vessel 200 can include a wetting stage, an incorporation stage, and a mixing stage. In some implementations, the continuous process vessel 200 can include more or fewer stages. When a solid (e.g., a powder) process ingredient and a liquid process ingredient are combined within the continuous process vessel 200, the first stage is wetting of the powder by the liquid. The liquid generally does not infiltrate into the powder matrix in this initial phase of mixing, but the liquid becomes coated by the powder. The combination tends to form balls of materials of various sizes and shapes that are comprised of wet cores and dry surfaces. The mixing regions of the wetting stage—for example, mixing regions 230*a* and 230*b*—can have be spacious enough to allow the process ingredients be freely agitated and not tightly constrained within the upper and lower angled surfaces—for example, upper angled surfaces 250*a* and 250*b*, and lower angled surfaces 240*a* and 240*b*. This free agitation can promote effective processing and bulk flow of the balls. Lack of sufficient space for free agitation may increase the occurrence of blockages.

The incorporation stage of acoustic mixing involves the incorporation of the solids on the surface of the balls into the liquid/powder core matrix. During the incorporation stage, the process ingredients may still form of balls of various sizes and shapes. The continued agitation of the continuous process vessel causes the liquids to incorporate throughout the balls, infiltrating the spaces between the powder matrix. This incorporation of liquid into the powder results in a decrease in total material volume. As the in-process materials increase in density, they requiring less volume for mixing. Thus, the incorporation stage of the continuous mixer module—for example, Layer 3—can have a narrower mixing region 230*c* than the mixing regions 230*a* and 230*b* of the wetting stage. The narrower mixing region 230*c* of the incorporation stage increases interaction between the in-process materials and the upper angled surface 250*c* and the lower angled surface 240*c*, thereby imparting energy into the materials to promote further mixing. In some implementations, without the constant and forceful impact of the upper angled surface 250*c* and the lower angled surface 240*c* on the materials, incomplete and non-uniformly mixed materials may escape the continuous process vessel 200.

Figure 3:
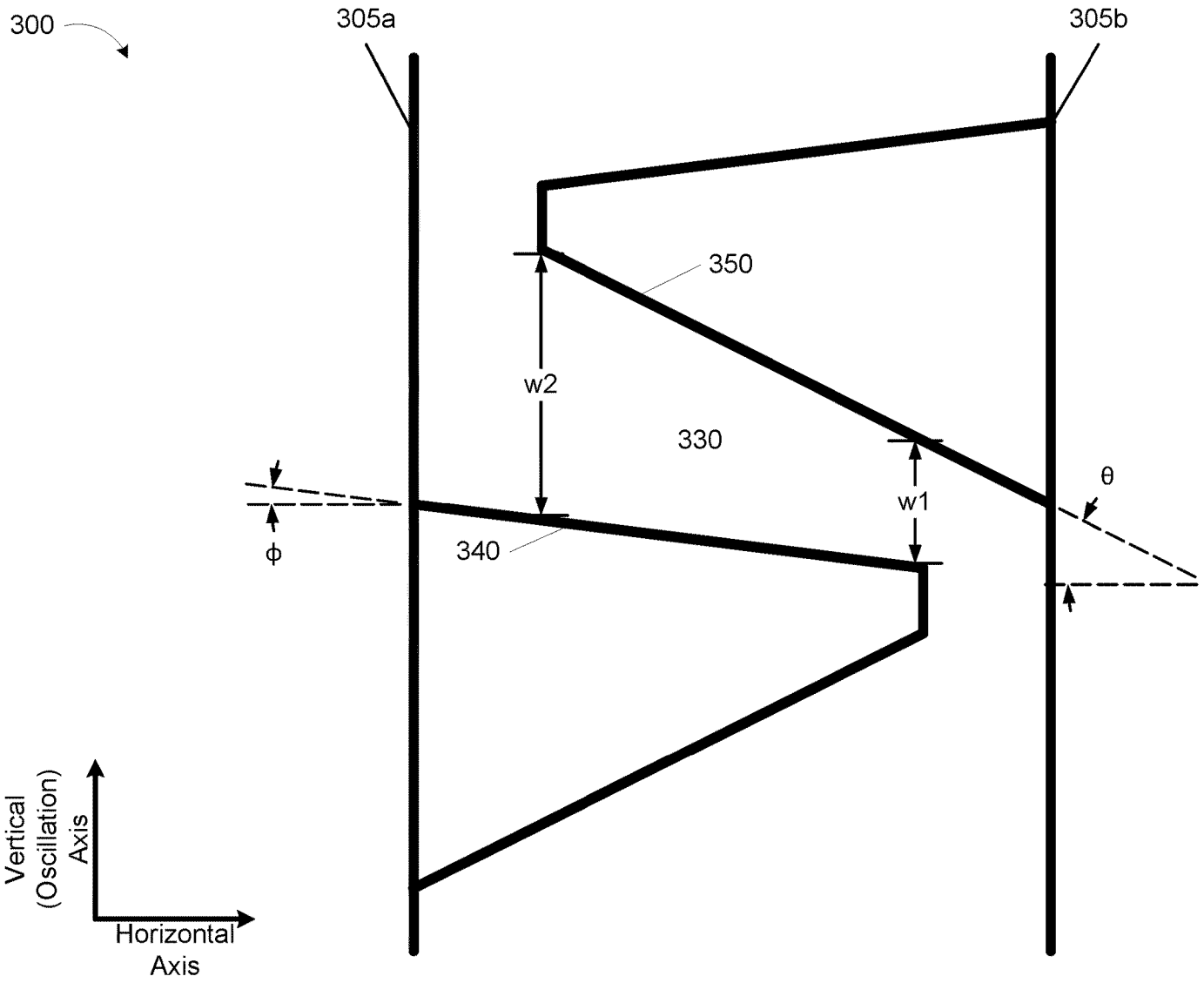
FIG. 3 shows a cross section of a mixing region of a continuous process vessel, according to an illustrative implementation.

The final mixing stage is characterized by the formation of a paste, or viscous liquid. As the incorporation of liquids into the powder balls progresses, the balls become more fluid and coalesce into a uniform paste, or viscous liquid. This paste is denser that the in process materials of the wetting and incorporation stages, as the powder is now fully incorporated into the liquid matrix and the balls have coalesced into a continuum of material. Thus, the mixing stage of the continuous process vessel 200—for example, Layers 4 through 7—can have narrower mixing regions 230 than the mixing regions 230 of the wetting and incorporation stages. In other words, the distances between the upper angled surfaces 250 and the lower angled surfaces 240 of the mixing stage are generally shorter in order to capture the materials being mixed. This capturing between the two surfaces is essential for imparting the acoustic energy on the in-process materials to enable thorough mixing and to drive the paste, or viscous liquid, toward the outlet 220. FIG. 3, described below, shows a cross section of a mixing region 230 with dimensions.

FIG. 3 shows a cross section of a mixing region 330 of a continuous process vessel 300, according to an illustrative implementation. The mixing region 330 can be a mixing region 230 of the continuous process vessel 200. FIG. 3 illustrates some of the dimensions described previously.

The continuous process vessel 300 has side walls 305*a* and 305*b* (collectively "side walls 305"). The side walls 305 are arranged substantially parallel to the vertical axis; i.e., the axis of oscillation. The continuous process vessel has an upper angled surface 350 and a lower angled surface 340. The upper angled surface 350 and the lower angled surface 340 are each coupled at one end to one of the side walls 305 of the continuous process vessel 300. The upper angled surface 350 and the lower angled surface 340 form the mixing region 330.

The upper angled surface 350 and the lower angled surface 340 of the mixing region 330 are angled with respect to the horizontal axis such that the distance between the upper angled surface 350 and the lower angled surface 340 is greater towards the upper portion of the continuous process vessel 300 than the distance between the upper angled surface 350 and the lower angled surface 340 towards the lower portion of the continuous process vessel 300. The upper angled surface 350 has an angle θ with respect to horizontal, and the lower angled surface 340 has an angle ϕ with respect to horizontal. The upper angled surface 350 and the lower angled surface 340 have a distance w between them at their closest point.

Table 1 below shows dimensions for one specific example of a continuous process vessel 200 or 300, according to some implementations. This example and the dimensions described are not intended to be limiting, but merely intended to describe a single possible implementation of a continuous process vessel. In this specific example, the continuous process vessel 200 includes two layers for the wetting stage, one layer for the incorporation stage, and four layers for the mixing stage. In some implementations, each stage can include more or fewer layers. Note that the each successive stage tends to have progressively narrower mixing region widths, with some exceptions. Each mixing region width (w1) is measured vertically at the mixing region's narrowest point; i.e., the point at which the upper angled surface 250 or 350 is closets to the lower angled surface 240 or 340 for that layer. Each mixing region width (w2) is measured vertically at the mixing region's widest point; i.e., the point at which the upper angled surface 250 or 350 is furthest from the lower angled surface 240 or 340 for that layer. The length of each plate in the horizontal direction is approximately 8 inches. In some implementations, however, the plates may be shorter or longer. Note also that the upper angled surface angle (θ) is generally greater than the lower angled surface angle (ϕ), with some exceptions. The angles are measured relative to the horizontal axis, where the horizontal axis is normal to the oscillation axis.

TABLE 1

Paste Processing CAM specific Example
Layer Configuration

| | | Angle | | Mixing region | |
|---|---|---|---|---|---|
| Layer | Stage | Upper (θ) | Lower (ϕ) | w1 | w2 |
| 1 | Wetting | 0° | 20° | 2.10 inches | N/A |
| 2 | Wetting | 10° | 1.5° | 1.61 inches | 2.79 inches |
| 3 | Incorporation | 10° | 1.5° | 1.61 inches | 2.79 inches |
| 4 | Mixing | 10° | 1.5° | 0.93 inches | 2.11 inches |
| 5 | Mixing | 10° | 1.5° | 0.93 inches | 2.11 inches |
| 6 | Mixing | 15° | 10° | 1.19 inches | 1.87 inches |
| 7 | Mixing | 10° | 1.5° | 0.75 inches | 1.93 inches |

Table 2 below shows example suitable ranges for dimensions of a continuous process vessel 200 or 300, according to some implementations. In this example, the continuous process vessel 200 or 300 includes two layers for the wetting stage, one layer for the incorporation stage, and four layers for the mixing stage. In some implementations, each stage can include more or fewer layers. The angles (θ and ϕ) are measured relative to the horizontal axis, where the horizontal axis is normal to the oscillation axis. Each mixing region width (w1) is measured vertically at the mixing region's narrowest point; i.e., the point at which the upper angled surface 250 or 350 is closets to the lower angled surface 240 or 340 for that layer. In some implementations, the width (w1) of the wetting stage mixing layers can be greater than 1 inch and less than 3 inches. In some implementations, the width (w1) of the incorporation stage mixing layers can be greater than 1 inch and less than 2 inches. In some implementations, the width (w1) of the mixing stage mixing layers can be greater than 0.5 inch and less than 1.5 inches. Each mixing region width (w2) is measured vertically at the mixing region's widest point; i.e., the point at which the upper angled surface 250 or 350 is furthest from the lower angled surface 240 or 340 for that layer. The length of each plate in the horizontal direction is approximately 8 inches. In some implementations, however, the plates may be shorter or longer.

TABLE 2

Paste Processing CAM Typical Ranges
Layer Configuration

| | | Angle | | Mixing region | |
|---|---|---|---|---|---|
| Layer | Stage | Upper (θ) | Lower (ϕ) | w1 | w2 |
| 1 | Wetting | 0° | 1°-35° | 0.25--5 inches | N/A |
| 2 | Wetting | 2°-35° | 1°-20° | 0.25-3 inches | 0.39-7.5 inches |
| 3 | Incorporation | 2°-35° | 1°-20° | 0.25-3 inches | 0.39-7.5 inches |
| 4 | Mixing | 2°-35° | 1°-20° | 0.25-3 inches | 0.39-7.5 inches |
| 5 | Mixing | 2°-35° | 1°-20° | 0.25-3 inches | 0.39-7.5 inches |

TABLE 2-continued

| Paste Processing CAM Typical Ranges Layer Configuration | | | | | |
|---|---|---|---|---|---|
| | | Angle | | Mixing region | |
| Layer | Stage | Upper (θ) | Lower (ϕ) | w1 | w2 |
| 6 | Mixing | 2°-35° | 1°-20° | 0.25-3 inches | 0.39-7.5 inches |
| 7 | Mixing | 2°-35° | 1°-20° | 0.25-3 inches | 0.39-7.5 inches |

Table 2 shows that, in some implementations, most of the lower angled surface angles (ϕ) are greater than 1° and less than 20°, and most of the upper angled surface angles (θ) are greater than 2° and less than 35°. In some implementations, each lower angled surface angle (ϕ) is greater than 1° and less than 5°, and each upper angled surface angle (θ) is greater than 5° and less than 20°. Table 2 shows that, in some implementations, the distance (w1) between the lower angled surface 240 or 340 and the upper angled surface 250 or 350 of each mixing layer 230 or 330 is between 0.25 inches and 3 inches at their closest point, and between 0.39 inches and 7.5 inches at their furthest point. In some implementations, the mixing region width (w1) of each stage is narrower than the mixing region widths (w1) of the previous stage.

An example method of operation of the CAM 100 and the continuous process vessel 200 or 300 will now be described with reference to FIG. 4.

Figure 4:
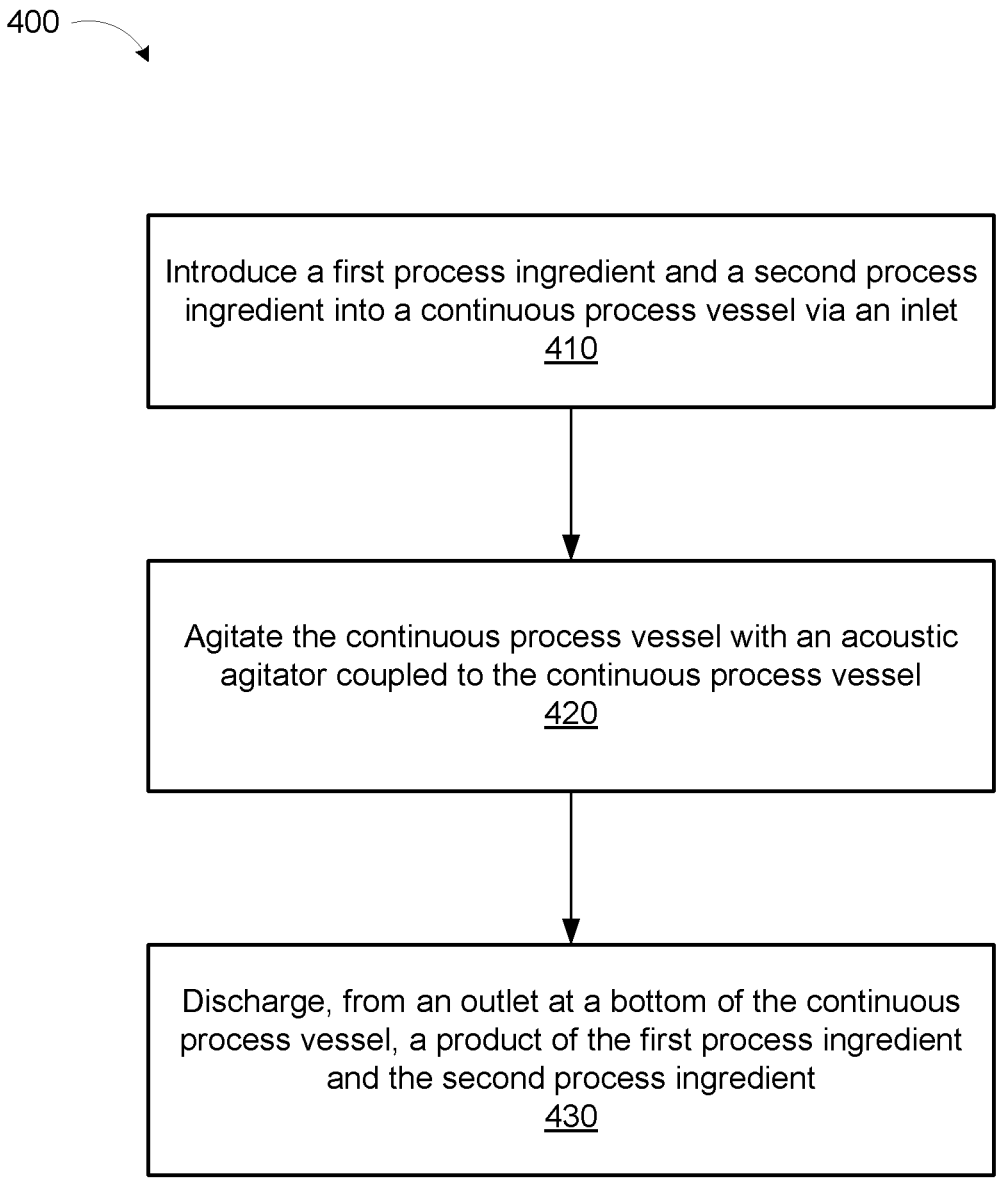
FIG. 4 is a flowchart of an example method for continuously processing a combination of materials, according to an illustrative implementation.

FIG. 4 is a flowchart of an example method 400 for continuously processing a combination of materials, according to an illustrative implementation. The method 400 can be performed using a continuous acoustic mixer (CAM) such as the CAM 100 previously described. The method 400 includes introducing at least a first process ingredient and a second process ingredient into a continuous process vessel via at least one inlet (stage 410). The method 400 includes agitating the continuous process vessel with an acoustic agitator coupled to the continuous process vessel (stage 420). The method 400 includes discharging a product of the first process ingredient and the second process ingredient (stage 430). These stages are described in further detail below.

The method 400 includes introducing at least a first process ingredient and a second process ingredient into a continuous process vessel via at least one inlet (stage 410). The continuous process vessel can be the continuous process vessel 120, 200, or 300 previously described. The continuous process vessel can include a plurality of mixing layers. Each mixing layer defines a mixing region having an upper angled surface and a lower angled surface. Each angled surface is coupled at one end to (or extends out from) one of the side walls of the continuous process vessel. The upper angled surfaces are oriented to face the outlet and are angled with respect to a horizontal axis, which is normal to the oscillation axis. The lower angled surfaces are oriented to face the at least one inlet and are angled with respect to the horizontal axis. The upper and lower angled surfaces form a plurality of mixing regions, each mixing region defined by an upper angled surface and an opposing lower angled surface. The upper angled surface and the lower angled surface of each mixing region are angled with respect to the horizontal axis such that the distance between the upper angled surface and the lower angled surface is greater towards the upper portion of the continuous process vessel than the distance between the upper angled surface and the lower angled surface towards the lower portion of the continuous process vessel. Accordingly, the mixing region narrows in a desired direction of desired bulk flow. In some implementations, the first process ingredient can be a liquid. In some implementations, the second process ingredient can be a solid, such as a powder, grains, or gravel. In some implementations, one of the process ingredients can be a liquid process ingredient, and the method can include adding gas, such as air, nitrogen, oxygen, argon, hydrogen, helium, carbon dioxide, neon, fluorine, chlorine, xenon, or other vapors, or combinations thereof, to the liquid process ingredient prior to introducing the liquid process ingredient into the continuous process vessel. The gas bubbles can be introduced to adjust the physical properties of the liquid process ingredient to improve mixing action in the continuous process vessel.

The method 400 includes agitating the continuous process vessel with an acoustic agitator coupled to the continuous process vessel (stage 420). The acoustic agitator can agitate the continuous process vessel along the oscillation axis. The acoustic agitator can be the acoustic agitator 110 described previously. In some implementations, the acoustic agitator can agitate the continuous process vessel along the oscillation axis with a displacement greater than 0.125 inches and less than 1.5 inches. In some implementations, the acoustic agitator can agitate the continuous process vessel with an acceleration greater than 1G and less than 200 Gs. In some implementations, the acoustic agitator can agitate the continuous process vessel at a frequency greater than 1 Hz and less than 1 KHz. In some implementations, the acoustic agitator can agitate the continuous process vessel at a frequency greater than 10 Hz and less than 100 Hz. In some implementations, the acoustic agitator can agitate the continuous process vessel at a frequency of approximately 60 Hz. In some implementations, the CAM system can operate at or near mechanical resonance. Resonant operation can facilitate efficient transfer of energy into the continuous process vessel, and by extension into the first and second process ingredients.

The method 400 includes discharging a product of the first process ingredient and the second process ingredient (stage 430). The outlet can be positioned towards a lower portion, with respect to the oscillation axis, of the continuous process vessel. The product can be discharged subsequent to the first process ingredient and the second process ingredient passing through at least a portion of the continuous process vessel while being exposed to the acoustic energy transferred by at least one upper angled surface and one lower angled surface. In some implementations, the product is a paste or viscous liquid.

Figure 5A:
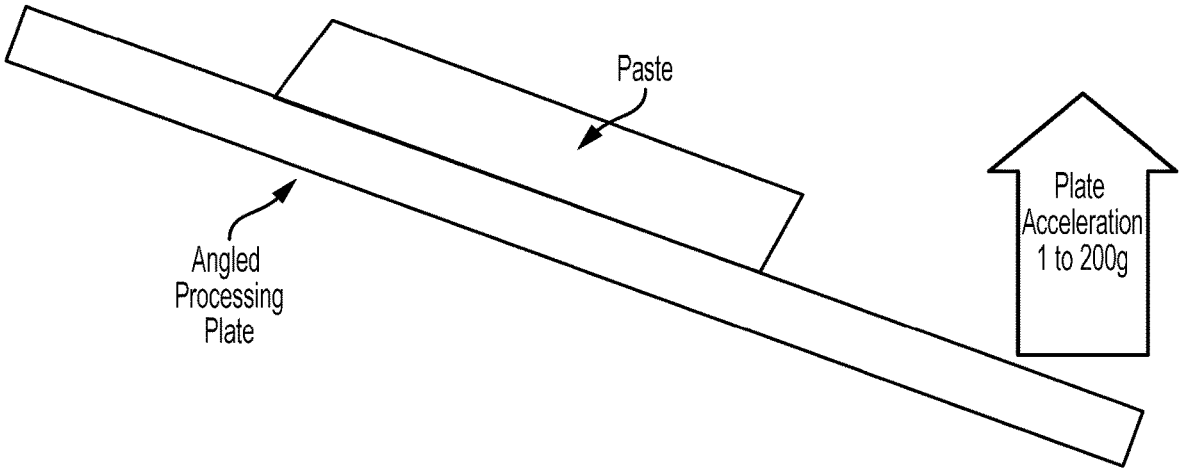
FIGS. 5A-5G illustrate the mechanisms of roll-back on an angled plate in a continuous process vessel of a continuous acoustic mixer.
Figure 5B:
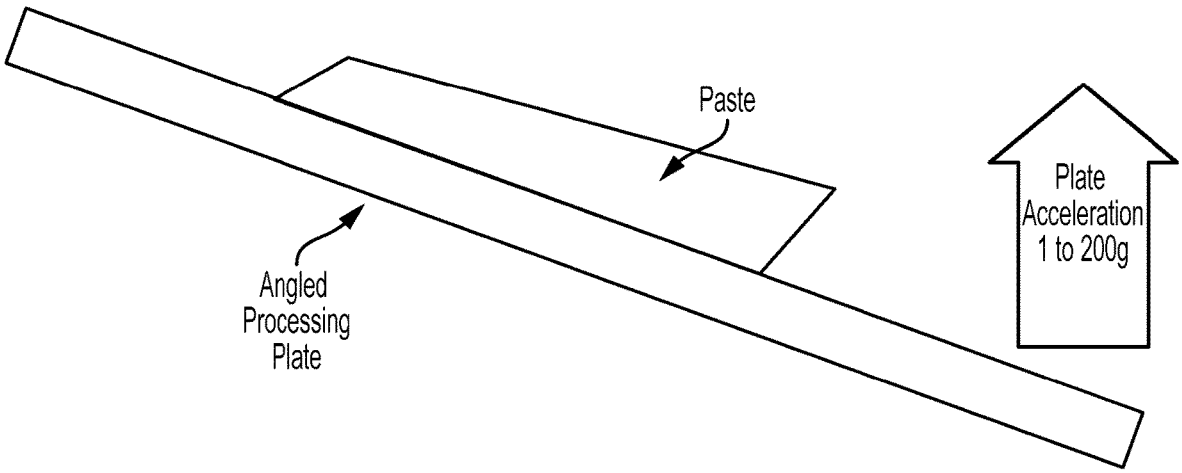
Figure 5C:
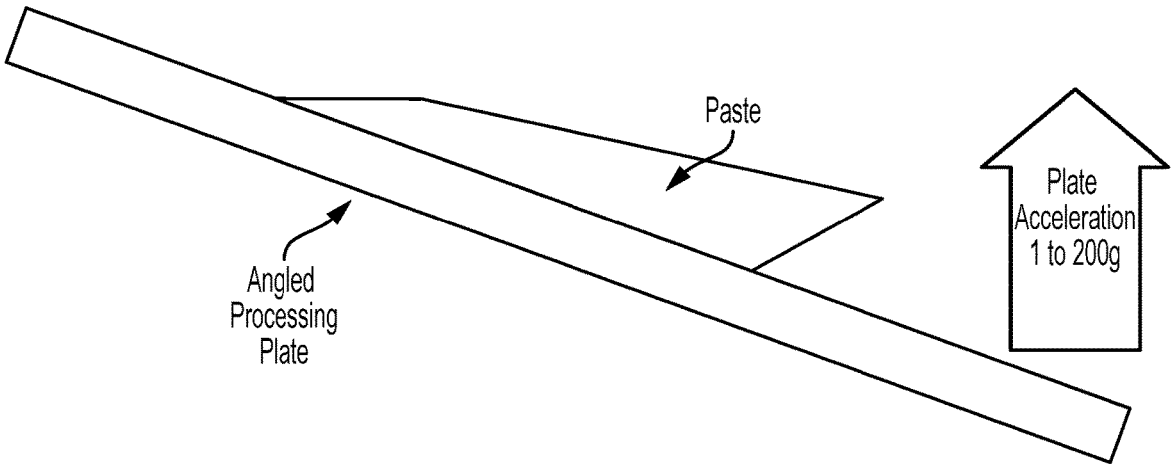

FIGS. 5A-5G illustrate the mechanisms of roll-back on an angled plate in a continuous process vessel of a continuous acoustic mixer. FIGS. 5A to 5C illustrate how a blob of paste on the angled plate deforms under the force of an upwards acceleration. A top portion of the paste shifts to the right as the force of acceleration pulls it downwards. A bottom portion of the paste exhibits less of a rightward shift due to adhesion between a bottom surface of the paste and the angled plate. The paste can therefore form a right-facing protrusion.

Figure 5D:
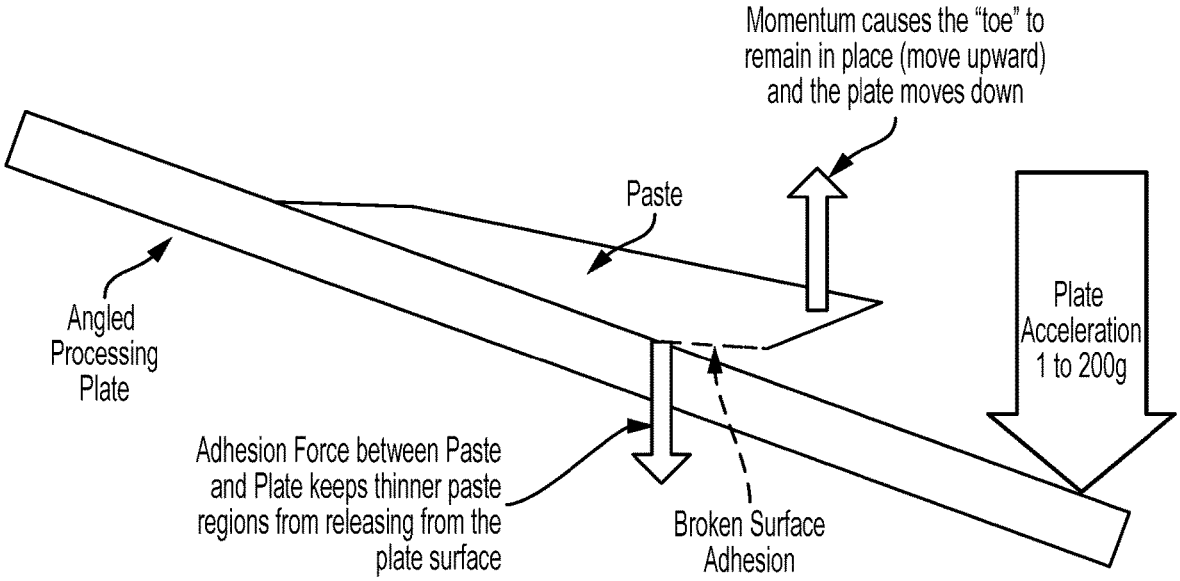
Figure 5E:
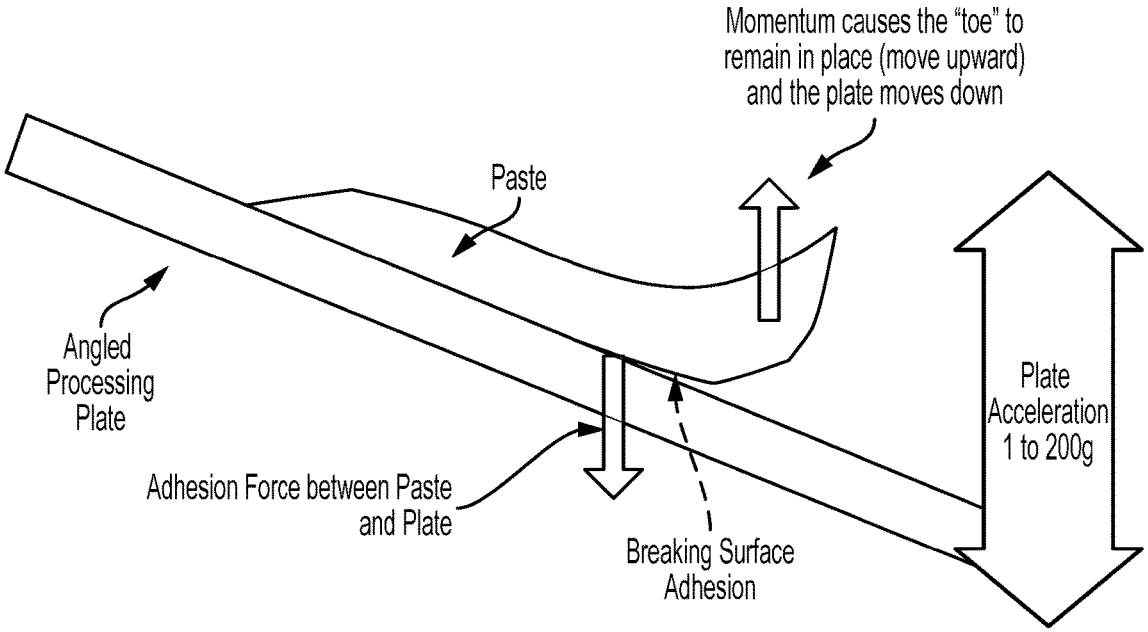

FIGS. 5D and 5E illustrate how the right-facing protrusion of paste can be pulled upward during a downwards acceleration of the angled plate. The downwards acceleration generates an upwards force on the paste. When the cohesive force in the paste is greater than the adhesive force between the paste and the angled plate, the force breaks the adhesion between the bottom surface of the paste and the angled plate. As a result the upwards force can pull the right-facing protrusion up away from the angled plate. The right-facing protrusion therefore becomes more pronounced.

Figure 5F:
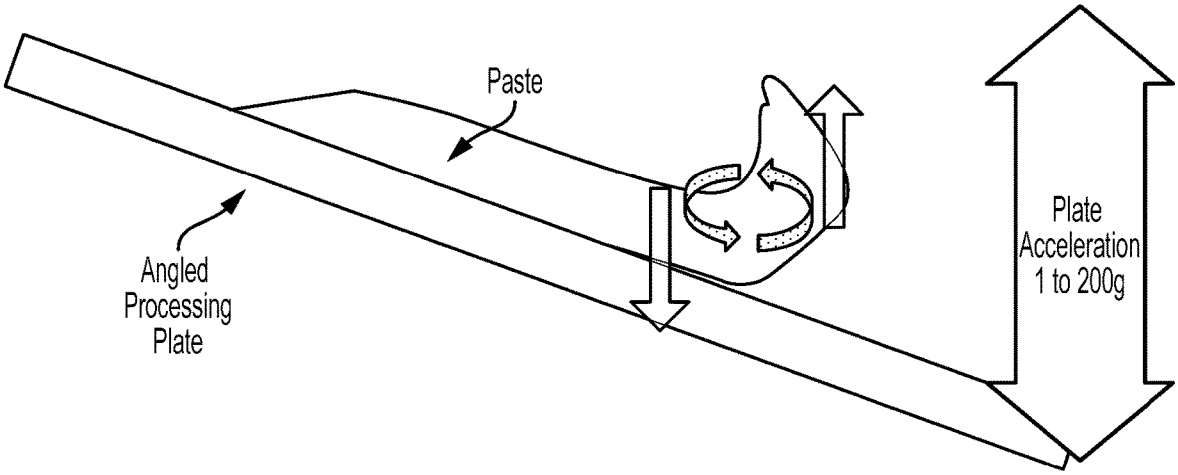
Figure 5G:
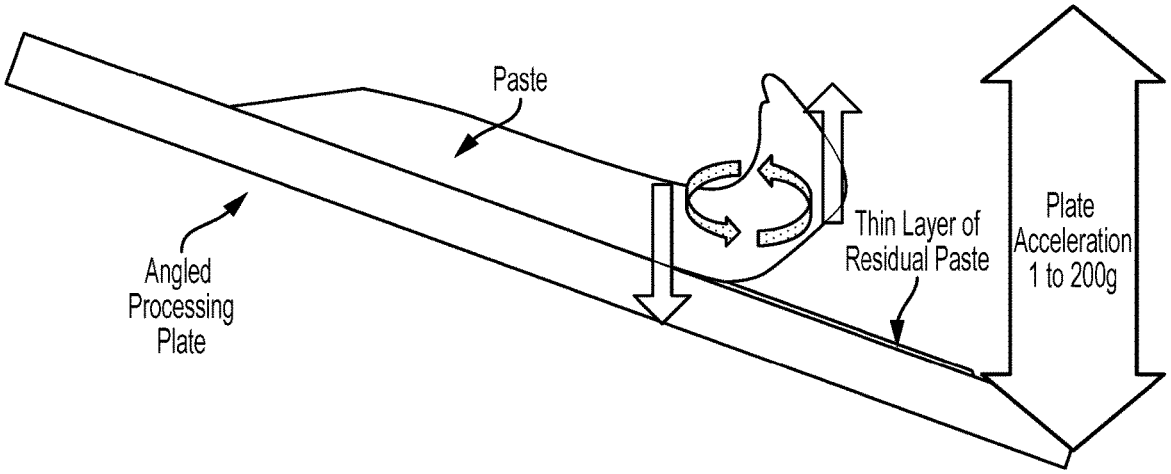

FIGS. 5F and 5G illustrate how, under repeated cycles of alternating upwards and downwards acceleration, the right-facing protrusion of paste can roll-back; that is, the paste protrusion can continue rotating up and backwards until it folds over in the upstream direction. In some cases, the roll-back can be severe enough to block the gap between the upper surface and the continuous process vessel wall, eventually leading to chugging as previously described.

Figure 6:
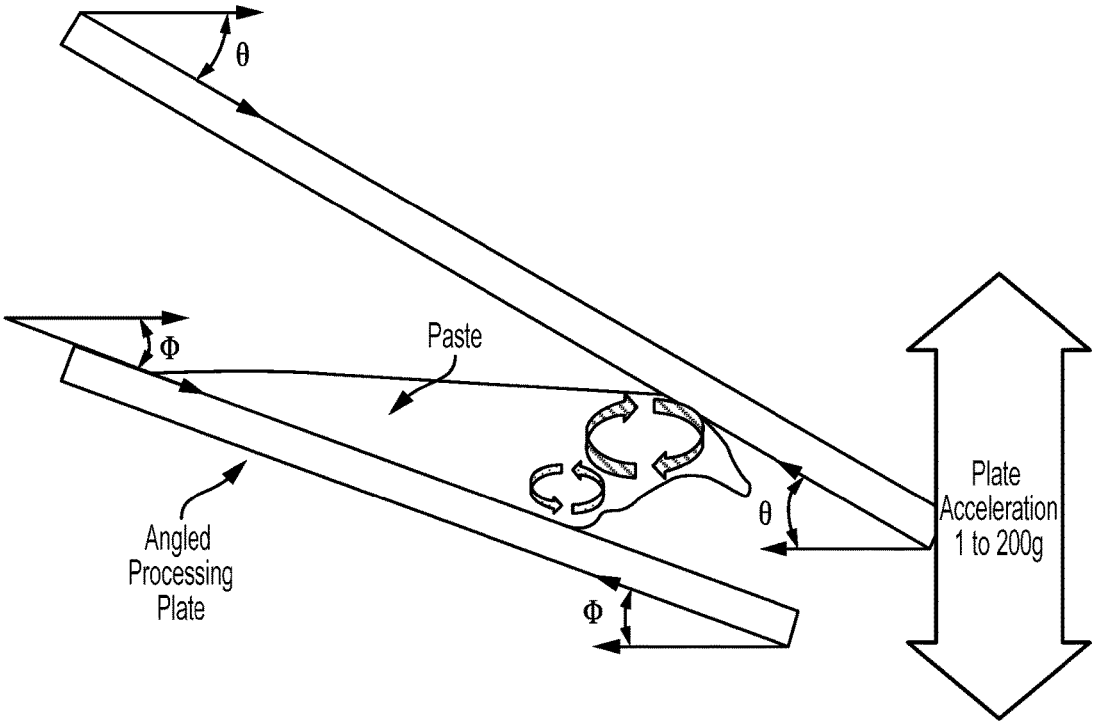
FIG. 6 is a diagram showing reduction of roll-back caused by narrowing upper and lower surfaces in a continuous process vessel, according to an illustrative implementation.

FIG. 6 is a diagram showing reduction of roll-back caused by narrowing upper and lower surfaces in a continuous process vessel, according to an illustrative implementation. FIG. 6 shows an angled plate similar to that used in the example shown in FIGS. 5A through 5G, and also includes the addition of a second upper angled plate. The convergence of the two angled plates in the downward direction can interfere with the roll-back. The addition of the upper angled plate can both halt the motion of roll-back from paste adhered to the bottom plate as well as generate a counter roll-back (or "push-forward") in the downstream direction. The result is smoother downstream flow and a reduction or elimination of chugging.

Many variations of the present application will occur to those skilled in the art. Some variations include more or fewer layers. Other variations mixing regions having different dimensions or shapes. All such variations are intended to be within the scope and spirit of the present application.

Although some implementations are shown to include certain features or steps, the applicants specifically contemplate that any feature or step disclosed herein can be used together or in combination with any other feature or step on any implementation of the present application. It is also contemplated that any feature or step can be specifically excluded from any implementation of the present application.

While the disclosure has been disclosed in connection with the implementations shown and described in detail, various modifications and improvements thereon will become readily apparent to those skilled in the art. Accordingly, the spirit and scope of the present disclosure is to be limited only by the following claims.

What is claimed is:

1. A system for continuously processing a combination of materials, the system comprising:

a continuous process vessel configured to oscillate along an oscillation axis, the continuous process vessel including:

a plurality of side walls extending along the oscillation axis; at least one inlet configured for introducing at least a first process ingredient and a second process ingredient into an upper portion, with respect to the oscillation axis, of the continuous process vessel;

an outlet positioned towards a lower portion, with respect to the oscillation axis, of the continuous process vessel, for discharging the product of mixing the first and second process ingredients as they traverse through the continuous process vessel; and a plurality of angled surfaces, each angled surface coupled at one end to one of the side walls of the continuous process vessel, wherein:

the plurality of angled surfaces include i) upper angled surfaces oriented to face the outlet and angled with respect to a horizontal axis, which is normal to the oscillation axis, and ii) lower angled surfaces oriented to face the at least one inlet and angled with respect to the horizontal axis, and the plurality of angled surfaces form a plurality of mixing regions, each mixing region defined by an upper angled surface and an opposing lower angled surface, wherein the upper angled surface and the lower angled surface of each mixing region are angled with respect to the horizontal axis such that the distance between the upper angled surface and the lower angled surface is greater towards the upper portion of the continuous process vessel than the distance between the upper angled surface and the lower angled surface towards the lower portion of the continuous process vessel such that at least one mixing region of the plurality of mixing regions narrows in a downstream direction; and an acoustic agitator coupled to the continuous process vessel and configured to agitate the continuous process vessel along the oscillation axis.

2. The system of claim 1, wherein each lower angled surface has an angle with respect to the horizontal axis that is greater than 1° and less than 20°, and each upper angled surface has an angle with respect to the horizontal axis that is greater than 2° and less than 35°.

3. The system of claim 1, wherein each lower angled surface has an angle with respect to the horizontal axis that is greater than 1° and less than 5°, and each upper angled surface has an angle with respect to the horizontal axis that is greater than 5° and less than 20°.

4. The system of claim 1, wherein the distance between the lower angled surface and the upper angled surface of each mixing region is between 0.25 inches and 3 inches at their closest point.

5. The system of claim 1, wherein:

the plurality of mixing regions is divided into a first mixing stage and a second mixing stage;

the upper angled surface and the lower angled surface of each mixing region in the first mixing stage are separated by a first distance at their closest point; and the upper angled surface and the lower angled surface of each mixing region in the second mixing stage are separated by a second distance less than the first distance at their closest point.

6. The system of claim 1, wherein:

the plurality of mixing regions is divided into a first mixing stage, a second mixing stage, and a third mixing stage;

the upper angled surface and the lower angled surface of each mixing region in the first mixing stage are separated by a first distance at their closest point;

the upper angled surface and the lower angled surface of each mixing region in the second mixing stage are separated by a second distance less than the first distance at their closest point; and the upper angled surface and the lower angled surface of each mixing layer in the third mixing stage are separated by a third distance less than the second distance at their closest point.

7. The system of claim 1, wherein the acoustic agitator is configured to agitate the continuous process vessel with a displacement along the oscillation axis that is greater than 0.125 inches and less than 1.5 inches.

8. The system of claim 1, wherein the system is configured to operate at mechanical resonance.

9. The system of claim 1, wherein the acoustic agitator is configured to agitate the continuous process vessel with an acceleration greater than 1G and less than 200 Gs.

10. The system of claim 1, wherein the acoustic agitator is configured to agitate the continuous process vessel at a frequency greater than 1 Hz and less than 1 KHz.

11. The system of claim 1, wherein the acoustic agitator is configured to agitate the continuous process vessel at a frequency greater than 10 Hz and less than 100 Hz.

12. A method for continuously processing a combination of materials, the method comprising:

introducing, via at least one inlet, at least a first process ingredient and a second process ingredient into an upper portion, with respect to an oscillation axis, of a continuous process vessel, wherein:

the continuous process vessel includes a plurality of angled surfaces, each angled surface coupled at one end to one of the side walls of the continuous process vessel;

the plurality of angled surfaces include i) upper angled surfaces oriented to face the outlet and angled with respect to a horizontal axis, which is normal to the oscillation axis, and ii) lower angled surfaces oriented to face the at least one inlet and angled with respect to the horizontal axis; and the plurality of angled surfaces form a plurality of mixing regions, each mixing region defined by an upper angled surface and an opposing lower angled surface, wherein the upper angled surface and the lower angled surface of each mixing region are angled with respect to the horizontal axis such that the distance between the upper angled surface and the lower angled surface is greater towards the upper portion of the continuous process vessel than the distance between the upper angled surface and the lower angled surface towards the lower portion of the continuous process vessel such that at least one mixing region of the plurality of mixing regions narrows in a downstream direction;

agitating the continuous process vessel with an acoustic agitator coupled to the continuous process vessel and configured to agitate the continuous process vessel along the oscillation axis; and discharging, from an outlet positioned towards a lower portion, with respect to the oscillation axis, of the continuous process vessel, a product of the first process ingredient and the second process ingredient subsequent to the first process ingredient and the second process ingredient passing through at least a portion of the continuous process vessel while being exposed to the acoustic energy transferred by at least one upper angled surface and one lower angled surface.

13. The method of claim 12, wherein the acoustic agitator is configured to agitate the continuous process vessel with a displacement along the oscillation axis that is greater than 0.125 inches and less than 1.5 inches.

14. The method of claim 12, wherein the acoustic agitator and the continuous process vessel operate at mechanical resonance.

15. The method of claim 12, wherein the acoustic agitator agitates the continuous process vessel with an acceleration greater than 1G and less than 200 Gs.

16. The method of claim 12, wherein the acoustic agitator agitates the continuous process vessel at a frequency greater than 1 Hz and less than 1 KHz.

17. The method of claim 12, wherein the acoustic agitator agitates the continuous process vessel at a frequency greater than 10 Hz and less than 100 Hz.

18. The method of claim 12, wherein each lower angled surface has an angle with respect to the horizontal axis that is greater than 1° and less than 20°, and each upper angled surface has an angle with respect to the horizontal axis that is greater than 2° and less than 35°.

19. The method of claim 12, wherein the first process ingredient is a liquid and the second process ingredient is a solid.

20. The method of claim 12, wherein the first process ingredient is a liquid and the second process ingredient is a viscous liquid.

21. The method of claim 12, wherein the product is a paste or a viscous liquid.

22. The method of claim 12, wherein at least one process ingredient is a liquid process ingredient, the method comprising:

adding gas to the liquid process ingredient prior to introducing the liquid process ingredient into the upper portion of the continuous process vessel.

23. The method of claim 12, comprising:

introducing, via the at least one inlet, a third process ingredient, wherein the third process ingredient is a gas.

* * * * *